United States Patent [19]

Barber et al.

[11] 3,962,066

[45] June 8, 1976

[54] RESILIENT LINER FOR AN ELECTROLYTIC CELL

[75] Inventors: Donald B. Barber, Los Angeles; Paul L. Everett, South Gate; Ivar Nou, North Hollywood; James Struebing, La Crescenta; William Greenbecker, Long Beach, all of Calif.

[73] Assignee: Barber-Webb, Los Angeles, Calif.

[22] Filed: Jan. 30, 1974

[21] Appl. No.: 437,965

[52] U.S. Cl. ..... 204/279; 204/275; 428/156; 220/63 R

[51] Int. Cl.[2] ..... C25B 9/00; B32B 3/00

[58] Field of Search ..... 204/242, 275, 279; 220/63 R, 65, DIG. 6, DIG. 18; 428/156, 172; 16/4

[56] References Cited

UNITED STATES PATENTS

| | | | |
|---|---|---|---|
| 1,024,936 | 4/1912 | Heller | 204/275 |
| 1,948,477 | 2/1934 | Zenner | 220/63 R X |
| 2,032,935 | 3/1936 | Hurt | 428/156 X |
| 2,395,606 | 2/1946 | Zinkil et al. | 220/63 R |
| 2,538,059 | 1/1951 | Strunk | 220/63 R X |
| 2,902,794 | 9/1959 | Ehrgott | 248/188.9 |
| 3,135,420 | 6/1964 | Fareell et al. | 220/63 R |
| 3,150,795 | 9/1964 | Schlumberger | 220/63 R X |
| 3,409,536 | 11/1968 | Barber et al. | 204/242 X |
| 3,559,231 | 2/1971 | Hill | 428/156 X |
| 3,612,036 | 10/1971 | Kaufman | 220/63 R UX |

*Primary Examiner*—T. Tung
*Assistant Examiner*—Aaron Weisstuch
*Attorney, Agent, or Firm*—Lyon & Lyon

[57] ABSTRACT

A liner of resilient material formed to fit into an electrolytic cell. The liner is a one-piece layer of polymeric or plastic material impervious to liquid electrolyte. Protrusions are provided on the outer side of portions of the liner to space the layer from the cell wall. This spacing allows drainage of the electrolyte from leaks in the layer brought about by the impacting of the electrodes against the cell wall. The protrusions also act to cushion such impacts reducing the extent of damage caused thereby.

1 Claim, 5 Drawing Figures

RESILIENT LINER FOR AN ELECTROLYTIC CELL

The present invention relates to cell liners for electrolytic cells such as those used to refine metals, e.g. copper, zinc, lead, cadmium, etc. More particularly, the present invention is directed to resilient cell liners having exterior protrusions to provide drainage of liquids interposed between the cell liner and the cell.

Electrolytic cells are employed for commercial processes involving treatment of materials by electrolysis. Electrolysis involves the producing of chemical changes by passage of an electric current through an electrolyte.

Cell liners are generally employed in electrolytic cells as a means for preventing deterioration of the supporting cell structure by the chemical effect of the electrolyte. Lead has been a conventional liner material. However, lead is both expensive and relatively difficult to install. Recently plastic liners have come into general and accepted use. The plastic liners have significant advantages over the conventional liners including resistance to attack by chemicals, low cost, ease of installation, maintenance and repair and elimination of stray electrical currents often associated with metal liners. One such liner is disclosed in Barber, et al U.S. Pat. No. 3,409,536, assigned to the assignee of the present invention. The disclosure of the Barber, et al patent is incorporated herein by reference.

In spite of the success of plastic liners employed in electrolytic cells, certain operational disadvantages have been encountered. Specifically, damage to such liners in the form of leaks often occurs when an electrode or other object placed within the cell impacts the wall of the cell. This is especially true of an electrowinning plant in which the cathode loop often fails. Such impacts are also quite frequent in a soluble anode system.

The leaks created in the liners by such impacts often result in the electrolyte weeping through the liner to contact the concrete. The hydraulic pressure of the electrolyte within the resilient cell liner commonly prevents the lost electrolyte interposed between the cell liner and the cell wall from passing to the drain at the bottom of the cell. The stagnant electrolyte then acts to rapidly deteriorate the concrete cell wall. The concrete often obtains the consistency of mush when acted upon by leaking electrolyte. Ultimately, failure of the cell results requiring a shut down of the electrolytic process and replacement or repair of the cell and liner.

One partial and relatively unsuccessful solution to this problem is to employ renewable timber floors beneath the cell liners. Such floors facilitate repair of the cells but still require the shut down of the process, the removal of the liner and the replacement of the timber. Attempts have also been made to provide either vertical slots or vertical ridges in the exterior surface of the liners. These attempts have met with general lack of success due to the cost of the molds and difficulties encountered in producing such liners. Further, the areas between the ribs or in the slots tend to collapse and close off the passageways provided therein.

The present invention incorporates a liner having protrusions on at least a portion of the outer surface thereof. The protrusions operate to space the liner from the cell wall in areas where damaging impact can be expected. The spacing allows substantially unrestricted flow of leaking electrolyte to the drain area. Further, the protrusions are set into a pattern to prevent the hydraulic head within the liner from closing off the passageways for the electrolyte to drain. The pattern and size of the protrusions also operate to increase the overall resiliency of the liner structure to improve the impact resistance thereof.

The protrusions are conveniently in a conical configuration. Conical depressions are easily provided in a mold thereby retaining a low mold cost for making the cell liners. Further, the cones have a large cone angle enabling them to be easily formed and extracted from the mold during production manufacture of the liners. As a result, the present liners can provide good drainage to the area between the liner and the cell wall and not incur the detriments of manufacture inherent in the molding of ridges or grooves.

Accordingly, it is an object of the present invention to provide an improved electrolytic cell liner.

It is another object of the present invention to provide an electrolytic cell liner capable of draining fluid from between the cell liner and the cell wall.

A further object of the present invention is to provide an easily fabricated electrolytic cell liner having protrusions to space the liner from the wall of the cell.

Another object of the present invention is to provide an easily fabricated electrolytic cell liner defining passageways for drainage of liquid from between the liner and the cell wall and exhibiting improved impact strength in areas of the cell prone to severe impact loading.

Other and more detailed objects and advantages will appear hereinafter.

Figure 1:
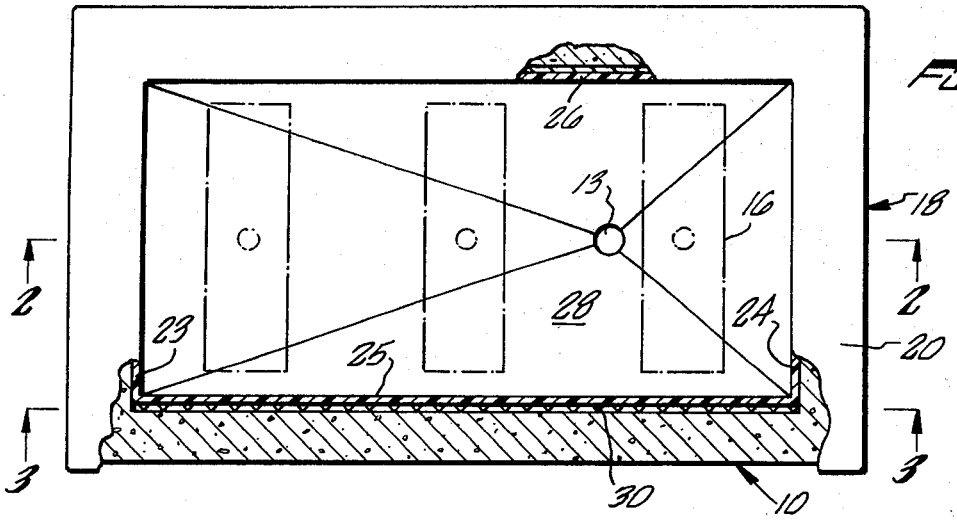
FIG. 1 is a top view of an electrolytic cell having a liner of the present invention positioned therein.
Figure 2:
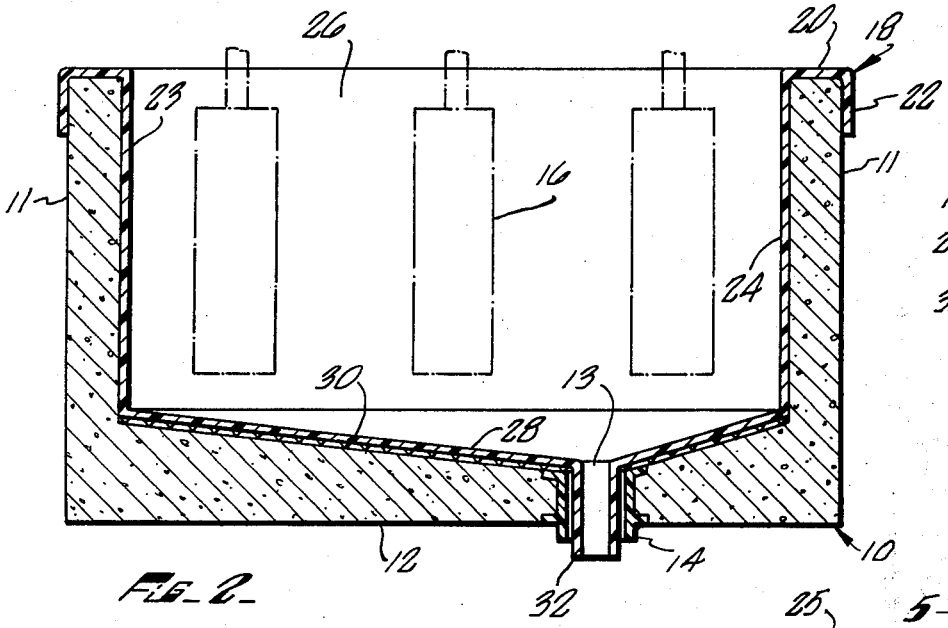
FIG. 2 is a cross-sectional elevation of the cell and liner taken along line 2—2 of FIG. 1.
Figure 5:
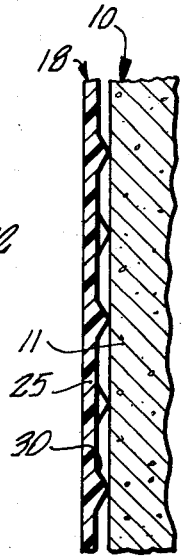
FIG. 5 is a cross-sectional view of the liner taken along line 5—5 of FIG. 4.
Figure 3:
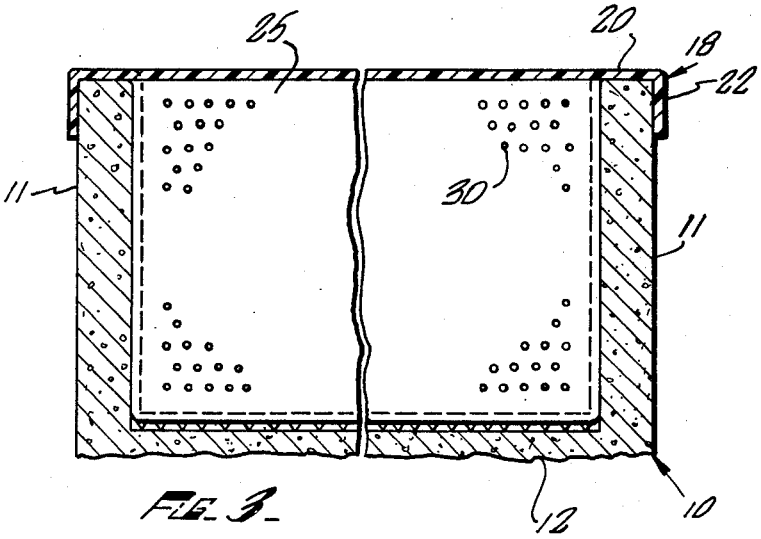
FIG. 3 is a cross-sectional elevation of the cell and liner taken along line 3—3 of FIG. 1.

Turning specifically to the drawings, a concrete electrolytic cell structure, generally designated 10, is disclosed. The cell structure 10 may also be of wood or metal where such construction is found to be advantageous. The material employed to define the cell structure 10 does not directly affect the present invention. Consequently, any suitable cell structure may be employed with the present invention. The cell 10 includes a cell cavity defined by four walls 11 and a bottom 12. The bottom 12 is conveniently sloped to provide enhanced drainage and includes at the lower most portion thereof a drain 13 through a drain insert 14. The shape of the cell 10 is determined by user preference. In the present embodiment, a rectangular cell is provided. Generally, electrolytic cells are approximately 14 feet long and 4 feet wide. It is also common to employ a cell having a depth of 4 feet. The cell cavity generally receives electrodes which are suspended from above as shown in phantom in FIGS. 1 and 2 as suspended blocks 16.

A resilient liner, generally designated 18, for the electrolytic cell is formed to approximately conform to the interior of the electrolytic cell. The liner 18 is molded into a single layer of resilient plastic material having a thickness in the present embodiment of approximately one eighth of an inch. The layer is preferably impervious to electrolytes. The sizes of the liner 18 relative to the cell 10 and the various methods for forming the liner 18 into a single piece are subjects fully discussed in the Barber, et al U.S. Pat. No. 3,409,536 incorporated herein by reference. It has been found that a polyvinylchloride plastisol, also discussed in the Barber et al patent, is well suited to the present application. It is to be understood that other plastics may be used with similar results.

The liner 18 extends over the upper edge of the cell walls 11 forming a flange 20. The flange 20 includes a depending skirt 22. The flange 20 and skirt 22 prevent unnecessary spillage of electrolyte and other materials between the cell walls 11 and the resilient liner 18. Further, the flange 20 and skirt 22 help support the walls of the resilient liner 18. Depending from the flange 20 into the cell cavity are end walls 23 and 24 and side walls 25 and 26. A floor 28 extends between the end walls and side walls to cover the bottom 12 of the cell 10.

The end walls 23 and 24 of the resilinet liner 18 are typically not subjected to impacts by electrodes positioned within the cell 10. Consequently, the end walls 23 and 24 may be of conventional configuration lying immediately adjacent the cell walls 11. Naturally, where impact strength and drainage is required of the end walls, they may be provided with protrusions as discussed below.

The side walls 25 and 26 and the floor 28 of the resilient liner 18 substantially conform to the interior of the walls 11 and bottom 12 of the electrolytic cell 10. However, the side walls 25 and 26 and floor 28 are displaced a small distance from the interior of the cell 10. This spacing is maintained by a plurality of protrusions 30 extending from the outer surface of the resilient liner 18. The protrusions 30 need only be employed where improved impact strength and drainage is desired. It is generally believed that the sides of such electrolytic cells receive the most abuse from electrodes positioned therein. Consequently, it is considered advantageous in the present application to provide a system of protrusions 30 on the outer side of either side wall 25 and 26.

A liner drain 32 is formed at the bottom of the resilient liner 18. The liner drain 32 is most advantageously positioned concentrically within the drain 13 and extends below the drain insert 14 to prevent electrolyte from eating away either the drain insert 14 or the cell bottom 12. An annular space is provided between the liner drain 32 of the resilient liner 18 and the drain insert 14 of the cell 10. This allows liquid trapped between the cell 10 and the resilient liner 18 to flow into the discharge system.

In order that trapped electrolyte may pass from the spaces exterior to the two side walls 25 and 26, it is preferred that the floor 28 of the resilient liner 18 also employ a plurality of protrusions 30. With space provided between the floor 28 and the bottom 12 of the cell 10 and with the bottom 12 of the cell 10 having a sloping upper surface to the drain 13, the trapped electrolyte will readily pass from the lower edge of the side walls 25 and 26, beneath the floor 28, to the annular space between the drain insert 14 and the liner drain 32. In this way, electrolyte weeping through damaged portions of the side walls 25 and 26 can be eliminated through the drain 13.

Turning specifically to the individual protrusions 30, each protrusion is conveniently of a substantially uniform shape. The protrusions 30 are molded with and directly on the layer defining the resilient liner 18. Each protrusion 30 is conical in shape and extend, in the present embodiment, approximately one eighth of an inch from the surface of the resilient liner 18. The protrusions 30 have a relatively large cone angle which adds strength to each protrusion and facilitates the molding process. The base diameter of each protrusion 30 in the present embodiment is approximately three-eighths of an inch thereby making a height to base diameter ratio of approximately one-third. Naturally, many other configurations are possible. However, a conical cavity is easily formed in the mold and allows substantially unimpaired release of the protrusions 30 formed therein when the liner is removed from the mold. Further, the conical structure is not easily damaged to such an extent that the standoff characteristics of the overall system will be greatly impaired. At the same time the effective cross section of each protrusion is kept small to allow substantially unrestricted flow of leaking electrolyte to the drain area.

Figure 4:
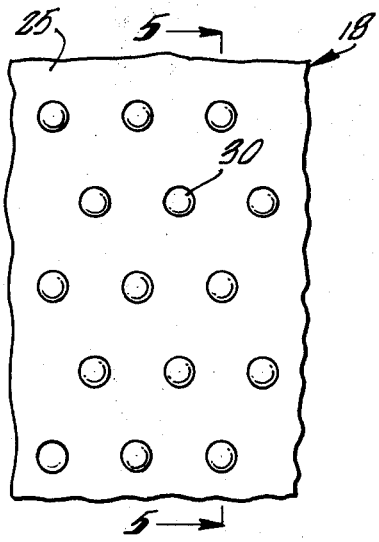
FIG. 4 is a detailed view of an exterior surface of the liner illustrating the protrusions.

Looking at the overall pattern of placement of the protrusions 30 as best seen in FIG. 4, the protrusions 30 are placed in horizontal rows. Each succeeding row is displaced horizontally from the succeeding row one-half the distance of the horizontal spacing between protrusions. Thus, each protrusion 30 in a succeeding row is positioned midway between the vertical projection of the nearest protrusion in the preceeding row of protrusions. This staggered placement reduces the width of any linear path which may be defined between protrusions and which might otherwise tend to collapse against the wall of the cell 10 between protrusions under the hydraulic pressure of the electrolyte. At the same time, the spacing between protrusions 30 is kept at a maximum to insure a substantially unrestricted path for liquid flow to the drain. The extent to which the pattern of protrusions 30 cover the sidewalls 26 is determined by the expected area of greatest impact abuse. On the exterior side of the floor 28, the pattern of protrusions preferably extend to receive all seepage from the areas of the side walls 26 having similar protrusions 30.

The spacing and size of the protrusions 30 are based on several considerations. It is important that the layer forming the resilient liner 18 be sufficiently supported so that it will not collapse under the hydrostatic pressure of the electrolyte against the inner surface of the cell 10. If the layer were to collapse, the passageways leading to the drain could be blocked. Thus, a large number of protrusions 30 are suggested. However, if a large number of protrusions 30 are employed, the passageways therebetween would be again reduced. Further, if the layer is made quite rigid by the employment of a large number of protrusions 30, the impact resistance of the liner 18 could be diminished. Naturally, the costs of material and detailed mold configurations also must be considered. The above described preferred embodiment has been found to adequately provide for all of these considerations. The layer does not collapse against the cell walls 11 and bottom 12 to preclude leaking electrolyte flow to the drain. There are not so many protrusions that flow is restricted. Finally, an increase in overall liner impact strength has been seen. Thus, the protrusions 30 of the preferred embodiment are properly sized and spaced to cooperate with an eighth inch layer of polyvinylchloride plastisol to provide an impact resistent, commercially economic electrolytic cell liner which allows substantially unrestricted flow of leaking electrolyte to the drain 13.

In the present embodiment, wherein the thickness of the polyvinylchloride layer is approximately one eighth inch, the height of each protrusion 30 is approximately one eighth inch and the base diameter of each protrusion 30 is three eighths inch, the horizontal center to center distance between protrusions 30 is established to be approximately one and one half inches. The vertical spacing between horizontal rows is also established at one and one half inches. The various figures illustrate the liner 18 and protrusions 30 to be somewhat larger than this preferred configuration. The protrusions 30 are exaggerated in the drawings for clarity of illustration.

The presence of the protrusions 30 at the high impact areas of the cell 10 operate to provide two beneficial functions. First, the spacing of the liner 18 from the walls 11 improves its impact strength in that added resiliency is given to the liner 18. Secondly, the relatively small protrusions 30 allows substantially unrestricted flow of leaking electrolyte down the sides of the cell 10 and across the bottom 12 to the drain 13. Thus, when a leak is created in the wall of the liner 18 by the impacting of an object against the inner side of the liner 18, the electrolyte which may slowly leak from the cell 10 will be able to run to the drain without substantial resistance. In this way, large quantities of acid will not accumulate at a given area on the cell 10 creating substantial deterioration thereof. Further, the staggered spacing of the protrusions 30 operate to prevent buckling of the liner 18 and thereby prevent blockage of flow from any leaks in the liner.

While embodiments and applications of this invention have been shown and described, it would be apparent to those skilled in the art that many more modifications are possible without departing from the inventive concepts herein described. The invention, therefore, is not to be restricted except by the spirit of the appended claims.

We claim:

1. A resilient liner for an electrolytic cell comprising a one-piece, resilient layer, said layer being impervious to electrolytes; and a plurality of protrusions disposed on at least a portion of the exterior surface of said layer, said protrusions being conical in shape and providing passageways between said layer and the cell for drainage of electrolytes trapped therebetween, said conical protrusions having a height to base diameter ratio of approximately one-third to facilitate the fabrication of the liner.

* * * * *